US006469282B1

(12) United States Patent
Roberts

(10) Patent No.: US 6,469,282 B1
(45) Date of Patent: Oct. 22, 2002

(54) BOIL DRY DETECTION IN COOKING APPLIANCES

(75) Inventor: Victor D. Roberts, Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/627,586

(22) Filed: Jul. 28, 2000

(51) Int. Cl.[7] ..... H05B 1/02

(52) U.S. Cl. ..... 219/481; 219/497; 219/506; 219/451; 219/453; 374/102

(58) Field of Search ..... 219/481, 497, 219/494, 501, 451–453; 374/101–103; 340/585, 584

(56) References Cited

U.S. PATENT DOCUMENTS

| | | | | |
|---|---|---|---|---|
| 4,740,664 A | | 4/1988 | Payne et al. | |
| 5,389,764 A | | 2/1995 | Nishii et al. | |
| 6,118,105 A | * | 9/2000 | Berkcan et al. | 219/497 |
| 6,140,772 A | * | 10/2000 | Bishop | 315/106 |
| 6,300,606 B1 | * | 10/2001 | Engelmann et al. | 219/492 |

OTHER PUBLICATIONS

U.S. application No. 09/356,965; filed Jul. 19, 1999, entitled: "Monitoring and Control System for Monitoring the Boil State of Contents of a Cooking Utensil".

U.S. application No. 09/356,964; filed Jul. 19, 1999, entitled: "Monitoring and Control System for Monitoring the Temperature of a Glass Ceramic Cooktop.".

U.S. application No. 09/627,585; filed Jul. 28, 2000, entitled: "Boil Dry Detection in Cooking Appliances".

* cited by examiner

*Primary Examiner*—Mark Paschall
(74) *Attorney, Agent, or Firm*—Pierce Atwood

(57) ABSTRACT

Boil dry conditions are detected in utensils heated on a glass-ceramic cooking appliance having at least one heating unit disposed under a glass-ceramic plate by monitoring the level of power supplied to the heating unit. A power level detector is electrically connected to the heating unit and generates a signal representative of the power level. A controller for controlling the heating unit so as to prevent the glass-ceramic plate from exceeding a maximum temperature is arranged to receive the power signal. The controller provides a boil dry indication in response to a decrease in the power signal. Alternatively, the controller can monitor the level of power being supplied to the heating unit by monitoring a signal generated to control the level of power, thereby eliminating the power level detector.

20 Claims, 3 Drawing Sheets

BOIL DRY DETECTION IN COOKING APPLIANCES

BACKGROUND OF THE INVENTION

This invention relates generally to detecting a boil dry condition in a utensil being heated on a cooking appliance and more particularly to boil dry detection in glass-ceramic cooking appliances.

The use of glass-ceramic plates as the cooking surface in cooking appliances such as cooktops and ranges is well known. Such cooking appliances (referred to herein as glass-ceramic cooktop appliances) typically include a number of heating units mounted under the glass-ceramic plate, one or more sensors for measuring the glass-ceramic temperature, and an electronic or electro-mechanical controller. The glass-ceramic plate presents a pleasing appearance and is easily cleaned in that its smooth, continuous surface lacks seams or recesses in which debris can accumulate. The glass-ceramic plate also prevents spillovers from falling onto the heating units below. The controller controls the power applied to the heating units in response to user input and input from the temperature sensors.

In one known type of glass-ceramic cooktop appliance, the glass-ceramic plate is heated predominantly by radiation from one or more of the heating units disposed beneath the plate. The glass-ceramic plate is sufficiently heated by the heating unit to heat utensils placed on it primarily by conduction from the heated glass-ceramic plate to the utensil. Another type of glass-ceramic cooktop appliance uses a heating unit that radiates substantially in the infrared region in combination with a glass-ceramic plate that is substantially transparent to such radiation. In these appliances, a utensil placed on the cooking surface is heated partially by radiation transmitted directly from the heating unit to the utensil, in addition to conduction from the glass-ceramic plate. Such radiant glass-ceramic cooktop appliances are more thermally efficient than other glass-ceramic cooktop appliances and have the further advantage of responding more quickly to changes in the power level applied to the heating unit. Yet another type of glass-ceramic cooktop appliance inductively heats utensils placed on the cooking surface. In this case, the heating unit is a coil connected to an RF generator; the coil emits RF energy when activated. The utensil, which comprises an appropriate material, absorbs the RF energy and is thus heated.

In each type of glass-ceramic cooktop appliances, provision must be made to avoid overheating the glass-ceramic plate. For most glass-ceramic materials, the operating temperature should not exceed approximately 600–700°C. for any prolonged period. Under normal operating conditions, the temperature of the glass-ceramic plate will generally remain below this limit. However, conditions can occur which can cause this temperature limit to be exceeded. Commonly occurring examples include operating the appliance with a small load or no load (i.e., no utensil) on the cooking surface, using badly warped utensils that make uneven contact with the cooking surface, and operating the appliance with a shiny and/or empty utensil.

To protect the glass-ceramic plate from extreme temperatures, a control system is utilized in which temperature sensors provide a signal indicative of the glass-ceramic temperature to the appliance's controller. If the glass-ceramic plate approaches its maximum temperature, a special control mode, known as the thermal limiter mode, is activated. In the thermal limiter mode, the controller reduces power to the heating units to maintain the temperature of the glass-ceramic cooking surface at a relatively constant, safe temperature.

Another concern with cooking appliance generally is a boil dry condition. A boil dry condition occurs when all the liquid contents of a heated utensil evaporate during the boil phase. This commonly happens when a utensil is inadvertently left on a hot cooking surface or otherwise overheated. A boil dry condition can cause burned food, utensil damage and potential fire hazards. Accordingly, automatic detection of a boil dry condition is a desirable feature in cooking appliances.

In glass-ceramic cooktop appliances, it is known to use the glass ceramic temperature to determine when a utensil has boiled dry. Specifically, when a utensil containing water or another liquid is placed on a glass-ceramic cooking surface and the burner is turned on, the glass-ceramic temperature initially increases rapidly. The glass-ceramic temperature will continue to rise until the utensil contents come to a boil. During the boil phase, the utensil contents will boil off at a steady temperature and remove excess heat via evaporation. With this steady heat removal, the glas s-ceramic temperature also reaches a steady state value some time after the contents come to a boil. However, when the liquid completely boils off, there is a sudden drop in heat removal from the pan, and consequently, the glass-ceramic temperature increases rapidly. This temperature rise is thus indicative of the boil dry condition.

This method of boil dry detection generally works well while the cooking appliance is in its standard operating mode. But under the thermal limiter mode, the glass-ceramic plate is being maintained at a relatively constant temperature by the controller. Therefore, the glass-ceramic temperature will not rise when upon a boil dry condition. Accordingly, it would be desirable to be able to automatically detect boil dry conditions while in the thermal limiter mode.

BRIEF SUMMARY OF THE INVENTION

The above-mentioned need is met by the present invention, which provides a boil dry detection system for a glass-ceramic cooking appliance having at least one heating unit disposed under a glass-ceramic plate and a power source for providing power to the heating unit. The boil dry detection system includes means for providing a signal representative of the level of power being supplied to the heating unit. A controller for controlling the power source so as to prevent the glass-ceramic plate from exceeding a maximum temperature is arranged to receive the power level signal. The controller provides a boil dry indication in response to a decrease in the power level signal.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
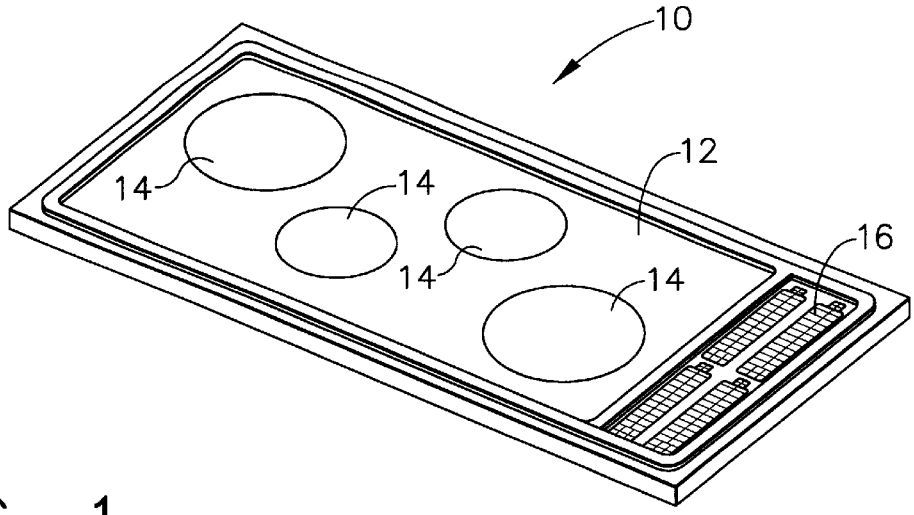
FIG. 1 is a perspective view of a glass-ceramic cooktop appliance incorporating a preferred embodiment of the present invention.

Referring to the drawings wherein identical reference numerals denote the same elements throughout the various views, FIG. 1 shows a glass-ceramic cooktop appliance 10 having a glass-ceramic plate 12 that provides a cooking surface. The appliance 10 can be any type of cooktop appliance including a range having an oven and a cooktop provided thereon or a built-in cooktop unit without an oven. Circular patterns 14 formed on the cooking surface of the plate 12 identify the positions of each of a number (typically, but not necessarily, four) of burner assemblies (not shown in FIG. 1) located directly underneath the plate 12. A control panel 16 is also provided. As is known in the field, the control panel 16 includes knobs, touch pads or the like that allow an operator of the appliance 10 to individually control the power applied to the burner assemblies.

Figure 2:
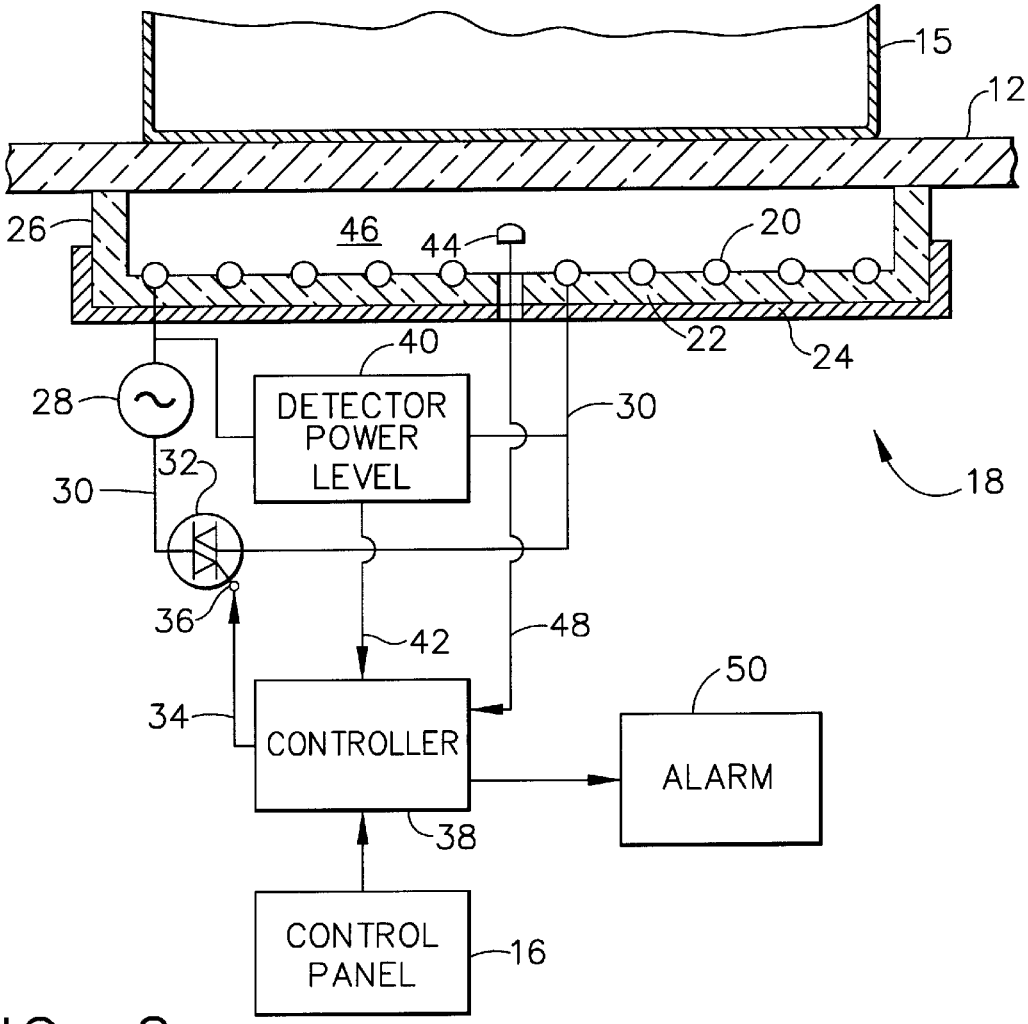
FIG. 2 is partly schematic view of a glass-ceramic cooktop appliance showing one of its burner assemblies in cross-section.

Turning to FIG. 2, an exemplary one of the burner assemblies, designated generally by reference numeral 18, is shown located beneath the glass-ceramic plate 12 so as to heat the plate 12 and/or a utensil 15 placed thereon. The burner assembly 18 includes a controllable heating unit 20 in the form of an open coil electrical resistance element, which is designed when fully energized to radiate primarily in the infrared region of the electromagnetic energy spectrum. It should be noted that other types of heating units could be used in place of the resistance element. The heating unit 20 is arranged in an effective heating pattern such as a concentric coil and is secured to the base of an insulating liner 22 which is supported in a sheet metal support pan 24. The insulating liner 22 includes an annular, upwardly extending portion 26 that serves as an insulating spacer between the heating unit 20 and the glass-ceramic plate 12. The support pan 24 is typically spring loaded upwardly, forcing the annular portion 26 into abutting engagement with the underside of the glass-ceramic plate 12, by conventional support means (not shown).

The heating unit 20 is coupled to a power source 28 (typically a standard 240 volt, 60 Hz AC power source) via suitable power lines 30. A power source control means such as a triac 32 is provided to regulate the level of power delivered to the heating unit 20. The triac 32 is a conventional semiconductor device capable of conducting current in either direction across its main terminals when triggered by either a positive or negative voltage or signal 34 applied to its gate terminal 36. An electronic controller 38 supplies the gate signal 34. The controller 38 controls the power applied to the heating unit 20 by controlling the rate at which gate signals 34 are applied to the triac gate terminal 36. The gate signal pulse rate is dictated by the power setting selections for the burner assembly 18 entered by user actuation of the control panel 16. Although not shown in FIG. 2, other heating units included in the appliance 10 are connected to the power source 28 in the same manner as, and in parallel with, the illustrated heating unit 20.

A power level detector 40 is electrically connected to the heating unit 20, preferably between the power source 28 and the heating unit 20, and generates a signal 42 that is directly or indirectly representative of the amount of power applied to the heating unit 20. In this sense, the power level detector 40 does not necessarily detect power directly, but is referred to herein as a "power level detector" because it provides the system with the means to detect the power level. The power level signal is fed to the controller 38. In one preferred embodiment, the power level detector 40 is any suitable circuit or device capable of measuring RMS voltage and generating a signal corresponding to the measured voltage. This controller 38 uses the measured voltage and the resistance of the heating unit 20 to determine the power level applied to the heating unit 20. Thus, the power signal 42 would be indirectly representative of the power level.

For purposes of the power calculation, the heating unit resistance is assumed to be constant. Although the heating unit resistance actually varies significantly over the entire operating range of the appliance 10, this resistance is fairly constant while the appliance is in its thermal limiter mode, which is described below. As also described below, the controller 38 uses the power signal primarily during thermal limiter mode operation. Thus, the assumption of a constant heating unit resistance is valid for the power calculation. This value of the heating unit resistance used in the calculation is a predetermined value that is based on a mean resistance value typically provided by the manufacturer.

Alternatively, the power level detector 40 could comprise conventional circuitry designed to measure the instantaneous current and instantaneous voltage and use these values to determine the power level. In this case, the power signal 42 is directly representative of the power level. However, such circuitry is generally more expensive.

A temperature sensor 44 is provided to detect the temperature of the glass-ceramic plate 12. In one preferred embodiment, the temperature sensor 44 is a resistive element, such as a resistance temperature detector, having a resistance that is very sensitive to temperature. The resistive element 44 is placed within the heater cavity 46 defined by the insulating liner 22 and the glass-ceramic plate 12. Alternatively, the temperature sensor 44 could be a resistance temperature detector or similar device attached directly to the underside of the glass-ceramic plate 12. In any event, the temperature sensor 44 generates a signal 48 indicative of temperature that is fed to the controller 38.

During normal operation, a user selects the desired cooking setting via manipulation of the control panel 16, and the controller 38 supplies gate signals 34 to the triac gate terminal 36 at an appropriate rate so as to provide the necessary level of power from the power source 28 to the heating unit 20. However, overheating of the glass-ceramic plate 12 should be avoided to insure long life. Thus, the controller 38 monitors the temperature signal 48 provided by the temperature sensor 44 to insure that the glass-ceramic temperature does not exceed a maximum safe level. Specifically, as the utensil 15 is being heated, the temperature of the glass-ceramic plate 12 will generally increase. If the glass-ceramic temperature reaches a preset value, which is typically in the range of 600–700° C., then the controller 38 will activate its thermal limiter mode to protect the glass-ceramic plate 12 from overheating. Under the thermal limiter mode, the controller 38 controls the pulse rate of the gate signals 34 such that the power supplied to the heating unit 20 is reduced to maintain the glass-ceramic temperature below the maximum safe level. Accordingly, the glass-ceramic temperature is maintained at a relatively constant level during the thermal limiter mode.

Figure 3:
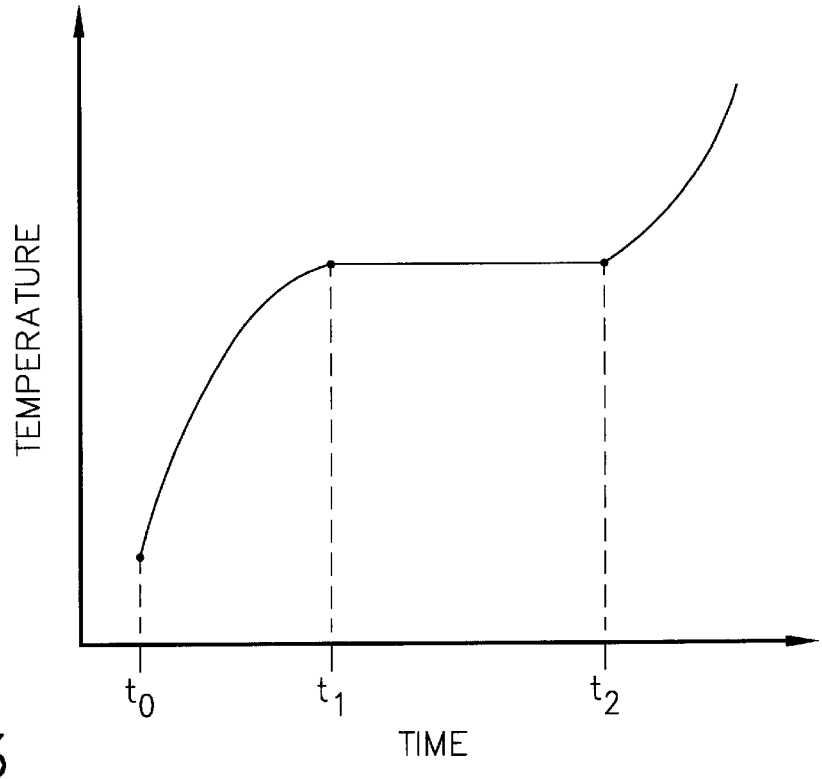
FIG. 3 is a graph plotting glass-ceramic temperature as a function of time.

The controller 38 also provides a boil dry detection function. As mentioned previously, a boil dry condition occurs when all the liquid contents of a heated utensil are boiled off. During normal operation, the controller 38 detects a boil dry condition based on temperature signal 48. This is illustrated by referring to FIG. 3, which shows a plot of the temperature signal 48 as a function of time. The utensil 15 is placed on the glass-ceramic plate 12 and the appliance 10 is turned on, at time $t_0$, causing the glass-ceramic temperature to increase from room temperature. The glass-ceramic temperature continues to rise until the utensil contents come to a boil. During the boil phase, the utensil contents will boil off at a steady temperature and remove excess heat via evaporation. With this steady heat removal, the glass-ceramic temperature also reaches a steady state value at time $t_1$, which is a short time after the contents have come to a boil. If the heating is continued, the liquid contents will eventually completely boil off, as shown at time $t_2$. At this point, there is a sudden drop in heat removal from the utensil 15, and consequently, the glass-ceramic temperature increases rapidly. This rise in the temperature signal 48 is thus indicative of the boil dry condition. In response to detecting a boil dry condition, the controller 38 shuts off power to the heating unit 20 and optionally sends a triggering signal to an alarm 50 (FIG. 2).

Figure 4:
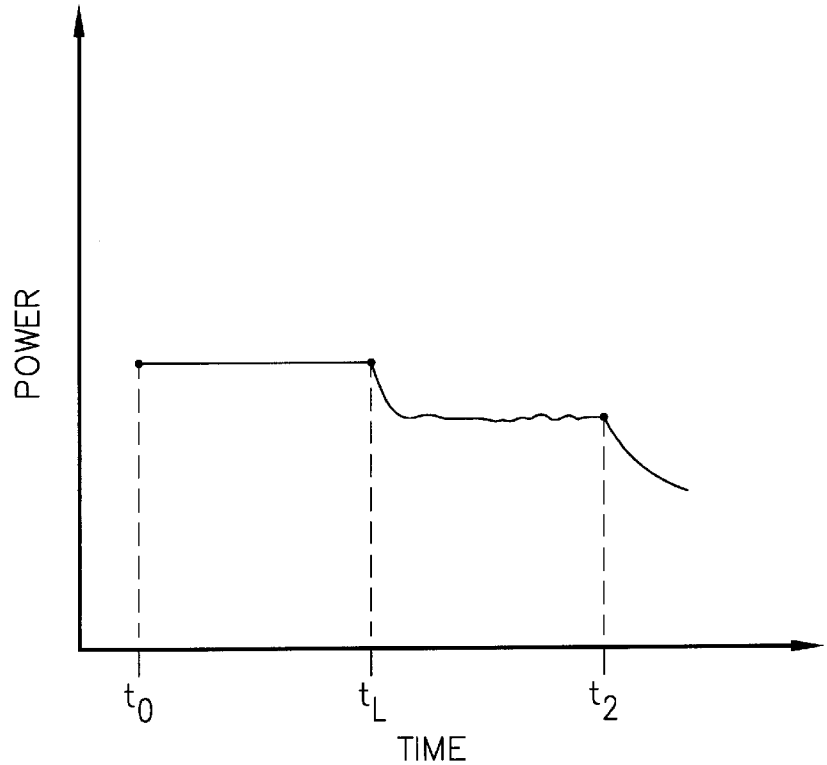
FIG. 4 is a graph plotting power level as a function of time.

In the thermal limiter mode, the temperature signal 48 is maintained at a steady state. This means that the temperature signal 48 will not rise if a boil dry condition occurs while the appliance 10 is operating under the thermal limiter mode. The controller 38 provides boil dry detection during the thermal limiter mode by monitoring the level of power applied to the heating unit 20 via the power signal 42 provided by the power level detector 40. Referring to FIG. 4, which shows a plot of the power signal 42 as a function of time, time $t_0$ again represents the point at which the utensil 15 is placed on the glass-ceramic plate 12 and the appliance 10 is turned on. The power level is determined by the desired cooking setting selected by the user via manipulation of the control panel 16 and generally remains constant as long as the cooking setting is unchanged by the user. The glass-ceramic temperature will increase and at some point, represented by time $t_L$ in FIG. 4, can reach the preset value causing the controller 38 to activate the thermal limiter mode. At this point, the controller 38 will reduce the power level supplied to the heating unit 20 so as to maintain the glass-ceramic plate 12 at a safe temperature.

At some point in the heating process (which could be either before of after the time $t_L$ when the thermal limiter mode is activated), the utensil contents come to a boil. During the boil phase, the utensil contents will boil off at a steady temperature and remove excess heat via evaporation at a steady rate. With this steady heat removal, the power level supplied to the heating unit 20 in order to maintain the glass-ceramic temperature at its safe level will generally remain steady, although there may be slight fluctuations in the power level due to changes in room temperature and the like. Continued heating will result in the liquid contents eventually being completely boiled off, as shown at time $t_2$. At this point, there is a sudden drop in heat removal from the utensil 15 meaning less power is required to maintain the glass-ceramic temperature. Therefore, the power signal 42 will show an abrupt drop that will be indicative of the boil dry condition. As before, the controller 38 will shut off power to the heating unit 20 and optionally send a signal to an alarm 50. Generally, the abrupt drop in the power signal 42 need be only on the order of about 2–3% over a period of a few seconds to trigger a boil dry indication.

Figure 5:
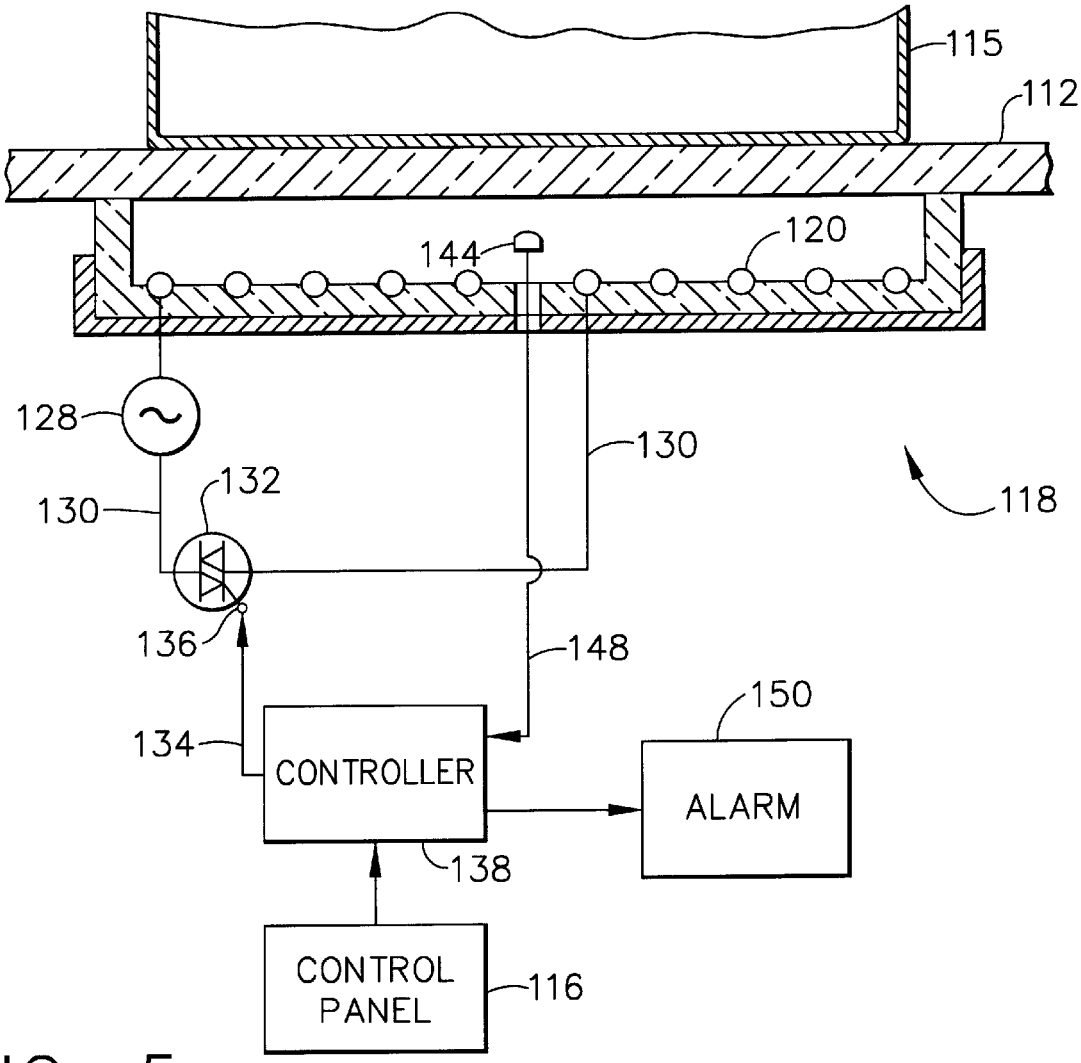
FIG. 5 is a partly schematic view of a glass-ceramic cooktop appliance showing an alternative embodiment of a burner assembly in cross-section.

FIG. 5 shows an alternative embodiment in which boil dry detection in the thermal limiter mode is accomplished by monitoring the level of power applied to the heating unit. However, in this embodiment, a separate power level detector is not used. Specifically, FIG. 5 shows a burner assembly 118 located beneath a glass-ceramic plate 112 so as to heat the plate 112 and/or a utensil 115 placed thereon. The burner assembly 118 includes a controllable heating unit 120, which is the same or similar to that of the first described embodiment. The heating unit 120 is coupled to a power source 128 (typically a standard 240 volt, 60 Hz AC power source) via suitable power lines 130.

A power source control means such as a triac 132 is provided to regulate the level of power delivered to the heating unit 120. The triac 132 is a conventional semiconductor device capable of conducting current in either direction across its main terminals when triggered by either a positive or negative voltage or signal 134 applied to its gate terminal 136. An electronic controller 138 supplies the gate signal 134. The controller 138 controls the power applied to the heating unit 120 by controlling the rate at which gate signals 134 are applied to the triac gate terminal 136. The gate signal pulse rate is dictated by the power setting selections for the burner assembly 118 entered by user actuation of the control panel 116. A temperature sensor 144, which is the same as or similar to the temperature sensor of the first described embodiment, is provided to detect the temperature of the glass-ceramic plate 112. In any event, the temperature sensor 144 generates a signal 148 indicative of temperature that is fed to the controller 138.

Boil dry detection during normal operation is accomplished in the same manner as described above. That is, the controller 138 monitors the temperature signal 148 where a rapid rise in the temperature signal 144 is indicative of a boil dry condition. Boil dry detection during the thermal limiter mode is accomplished monitoring the level of power applied to the heating unit 120, wherein an abrupt drop in the power level is indicative of a boil dry condition. Instead of monitoring the power level with a power level detector, the controller 138 monitors the gate signal pulse rate, which is controlled by, and thus "known" by, the controller 138. Because the power level is a function of the gate signal pulse rate, the gate signal 134, like the power signal 42 of the first described embodiment, is representative of the level of power being supplied to the heating unit 120. As before, the controller 138 shuts off power to the heating unit 120 and optionally sends a triggering signal to an alarm 150 in response to detecting a boil dry condition.

The foregoing has described a method and system for automatically detecting boil dry conditions, including monitoring the power level to detect boil dry conditions while operating in the thermal limiter mode. While specific embodiments of the present invention have been described, it will be apparent to those skilled in the art that various modifications thereto can be made without departing from the spirit and scope of the invention as defined in the appended claims.

What is claimed is:

1. A boil dry detection system for a cooking appliance having at least one heating unit, said system comprising:

means for providing a signal representative of a level of power being supplied to said heating unit; and means for monitoring said signal for boil dry detection, said means for monitoring said signal providing a boil dry indication in response to a decrease in said signal.

2. The boil dry detection system of claim 1 wherein said means for providing a signal comprises a power level detector electrically connected to said heating unit.

3. The boil dry detection system of claim 2 wherein said power level detector measures voltage and said controller determines said level of power being supplied to said heating unit from said measured voltage and a predetermined resistance value of said heating unit.

4. The boil dry detection system of claim 2 wherein said power level detector measures an instantaneous current and voltage and determines said level of power being supplied to said heating unit from said measured instantaneous current and voltage.

5. The boil dry detection system of claim 1 wherein said means for providing a signal controls said level of power being supplied to said heating unit.

6. The boil dry detection system of claim 1 wherein said means for monitoring said signal controls said level of power being supplied to said heating unit.

7. The boil dry detection system of claim 6 wherein said means for monitoring said signal shuts off power to said heating unit in response to a decrease in said signal.

8. The boil dry detection system of claim 1 wherein said means for monitoring said signal triggers an alarm in response to a decrease in said signal.

9. A boil dry detection system for a glass-ceramic cooking appliance having at least one heating unit disposed under a glass-ceramic plate and a power source for providing power to said heating unit,. said system comprising:

means for providing a signal representative of a level of power being supplied to said heating unit; and a controller controlling said power source so as to prevent said glass-ceramic plate from exceeding a maximum temperature, said controller monitoring said signal and providing a boil dry indication in response to a decrease in said signal.

10. The boil dry detection system of claim 9 wherein said means for providing a signal comprises a power level detector electrically connected to said power source.

11. The boil dry detection system of claim 10 wherein said power level detector measures voltage and said controller determines said level of power being supplied to said heating unit from said measured voltage and a predetermined resistance value of said heating unit.

12. The boil dry detection system of claim 10 wherein said power level detector measures an instantaneous current and voltage and determines said level of power being supplied to said heating unit from said measured instantaneous current and voltage.

13. The boil dry detection system of claim 9 wherein said controller shuts off power to said heating unit in response to a decrease in said signal.

14. The boil dry detection system of claim 9 wherein said controller triggers an alarm in response to a decrease in said signal.

15. A method of detecting a boil dry condition in a utensil being heated on a cooking appliance having at least one heating unit, said method comprising the steps of:

monitoring a level of power being supplied to said heating unit; and providing a boil dry indication in response to a decrease in said level of power being supplied to said heating unit.

16. The method of claim 15 wherein said step of monitoring a level of power being supplied to said heating unit comprises measuring a voltage applied to said heating unit and determining said level of power being supplied to said heating unit from said measured voltage and a predetermined resistance value of said heating unit.

17. The method of claim 15 wherein said step of monitoring a level of power being supplied to said heating unit comprises measuring an instantaneous current and voltage and determining said level of power being supplied to said heating unit from said measured instantaneous current and voltage.

18. The method of claim 15 wherein said step of monitoring a level of power being supplied to said heating unit comprises monitoring a signal generated to control said level of power being supplied to said heating unit.

19. The method of claim 15 further comprising the step of shutting off power to said heating unit in response to a boil dry indication.

20. The method of claim 15 further comprising the step of triggering an alarm in response to a boil dry indication.

* * * * *